US010145617B1

(12) United States Patent
Young

(10) Patent No.: US 10,145,617 B1
(45) Date of Patent: Dec. 4, 2018

(54) OVEN TEMPERATURE MONITORING SYSTEM

(71) Applicant: M. Joseph Young, Summerfield, NC (US)

(72) Inventor: M. Joseph Young, Summerfield, NC (US)

(73) Assignee: Advanced Temperature Monitoring Systems, LLC, Kernersville, NC (US)

( * ) Notice: Subject to any disclaimer, the term of this patent is extended or adjusted under 35 U.S.C. 154(b) by 194 days.

(21) Appl. No.: 14/840,200

(22) Filed: Aug. 31, 2015

(51) Int. Cl.
*F27D 21/00* (2006.01)

(52) U.S. Cl.
CPC ..... *F27D 21/0014* (2013.01)

(58) Field of Classification Search
CPC ..... F27D 21/0014
See application file for complete search history.

(56) References Cited

U.S. PATENT DOCUMENTS 3,582,921 A * 6/1971 Krieger ..... G01K 1/024 340/517
3,764,422 A * 10/1973 Koritke ..... B23K 1/00 174/254
3,974,696 A * 8/1976 Fitzmayer ..... A47J 37/00 219/712
4,149,056 A * 4/1979 Kaneshiro ..... G01K 1/00 219/712
4,377,733 A * 3/1983 Yamaguchi ..... G01K 1/024 219/516
4,381,439 A * 4/1983 Miyazawa ..... A47J 37/00 219/713
4,688,039 A * 8/1987 Berk ..... G12B 17/06 266/89
4,773,848 A * 9/1988 Jalbert ..... F23Q 9/08 126/116 A
4,988,211 A * 1/1991 Barnes ..... G01J 5/02 374/121

(Continued)

FOREIGN PATENT DOCUMENTS

JP 2014109545 A * 6/2014

OTHER PUBLICATIONS

Three (3) page printout from Gardco.com showing "Easy Track2 System by DataPaq", Copyright Paul N. Gardner Company, Inc., printout dated Jan. 21, 2014.

(Continued)

*Primary Examiner* — Nathaniel Herzfeld
(74) *Attorney, Agent, or Firm* — Tuggle Duggins P.A.; Blake Hurt

(57) ABSTRACT

An oven temperature monitoring system including a box top and a box body formed out of an alkene fluorocarbon material for monitoring the temperature and duration of a powder coat curing cycle is provided. The box top includes a receptacle in communication with a printed circuit board and an antenna that are secured within a housing on the inward facing surface of the box top. A pair of thermocouples are attached to an item that has been powder coated and communicates temperature data back to the electronic device that can be transmitted out of the oven during curing cycles to a computer monitored by a user. This information can be used to ensure proper curing time and temperature and significantly reduces wasted thermal energy due to incomplete or repeated cure cycles.

8 Claims, 2 Drawing Sheets

(56) References Cited

U.S. PATENT DOCUMENTS

| | | | | |
|---|---|---|---|---|
| 8,308,356 | B2 * | 11/2012 | Melgaard | F27D 21/00 361/700 |
| 2009/0188396 | A1 * | 7/2009 | Hofmann | G01K 1/024 99/342 |
| 2011/0259867 | A1 * | 10/2011 | Rock | H04Q 9/00 219/209 |
| 2012/0143559 | A1 * | 6/2012 | Wall | G01K 11/265 702/130 |

OTHER PUBLICATIONS

Four (4) page printout from Gardco.com showing "Oven Tracker XL2 Systems", Copyright Paul N. Gardner Company, Inc., printout dated Jan. 21, 2014.

* cited by examiner

OVEN TEMPERATURE MONITORING SYSTEM

FIELD OF THE INVENTION

The invention herein pertains to oven temperature accessories and particularly pertains to an oven temperature monitoring system for use with a powder coating process or the like that confirms proper metal temperature during the coating process.

DESCRIPTION OF THE PRIOR ART AND OBJECTIVES OF THE INVENTION

Powder coating is a process of applying dry powder to a substrate and curing the powder in place without the presence of a liquid solvent, resulting in a hard, thick finish that is typically harder and structurally more durable than conventional liquid finishes. Often used with metallic substrates, powder coating has become more popular in recent years as it may be applied more equally across horizontal and vertical surfaces, it emits fewer volatile organic compounds because of the lack of liquid vehicle, and can produce color blending and bleeding effects by applying multiple color layers and multiple curing processes.

One of the drawbacks of the powder coating process is the significant investment in fuel costs necessary to reach the proper temperatures for satisfactory curing. Another issue is the overall timing and logistics associated with using an oven to dry and cure the powder coated parts. For example, a part is usually dried after cleaning, indicating that the water must evaporate off the parts, taking at least three to five (3-5 minutes). As will be described further below, the powder coated parts must cure at a specific temperature for approximately ten to twenty (10-20 minutes), not including an over-bake buffer period that varies from powder to powder. The part does not immediately reach the necessary curing temperature in a curing cycle, so there is lost time to factor into the total cycle time as well. The resulting business impact is that by over-curing the coated products, fewer runs can be performed in a day, leading to less overall profitability. By saving even five to six (5-6) minutes off a curing cycle, on a typical day ten cycles are performed, meaning a whole hour can be recovered with precise and accurate monitoring of the oven temperature and performance during the cure cycle.

Common materials used in the powder coating process are polyester, polyurethane, polyester-epoxy (sometimes referred to as hybrid), "straight" or fusion-bonded epoxy, and acrylics which are mixed with a hardening agent and pigment agents, heated in an extruder, chipped off of a sheet and milled to form a fine powder. After the substrate is pretreated to ensure that no contaminant is on the surface of the substrate to be coated, the powder is administered, typically electrostatically, to the substrate and heated. Depending on the powder coating used, the curing process usually requires heat of about two hundred degrees Celsius (200° C. or almost 400° F.) for between fifteen and a hundred and five (15-105) minutes, permitting the production of a smooth film as a final product. In view of the size of standard powder coating curing ovens, and the heating elements conventionally used in convection ovens particularly, the time and resources required to conduct an operation of this type can be significant.

Thus, in view of the problems and disadvantages associated with prior art devices, the present invention was conceived and one of its objectives is to provide a device that visually communicates the part temperature to a user.

It is another objective of the present invention to provide a temperature-indicating box in thermal communication with a powder coated item within a curing oven.

It is still another objective of the present invention to provide an oven temperature monitoring system with a polytetrafluoroethylene (PTFE) container connected to a powder coated item within a curing oven via at least one pair of thermocouples.

It is yet another objective of the present invention to provide an oven temperature monitoring system including a thermal phase change material positioned within the PTFE container.

It is a further objective of the present invention to provide an oven temperature monitoring system with an electronic component for recording oven temperature positioned within the PTFE container.

It is still a further objective of the present invention to provide an oven temperature monitoring system with an electronic component for transmitting oven temperature without needing to open the oven.

It is yet a further objective of the present invention to provide an oven temperature monitoring system including a polytetrafluoroethylene box sealable with one or more metallic clasps and a rubber seal between the top and the box.

It is another objective of the present invention to provide an oven temperature monitoring system to be used in connection with paint drying, food preparation, and other mechanisms of heating where a material or member is required to be within a heated oven for a predetermined or specific amount of time.

Various other objectives and advantages of the present invention will become apparent to those skilled in the art as a more detailed description is set forth below.

SUMMARY OF THE INVENTION

The aforesaid and other objectives are realized by providing an oven temperature monitoring system including a box body and a top formed from polytetrafluoroethylene (CAS No. 9002-84-0), known commercially as Teflon™ and a powder coated item, the item and the box top connected by at least one thermocouple. The box top also includes a printed circuit board (PCB) in communication with the thermocouple and a nine hundred megahertz (900 MHz) wireless transmitter positioned within a housing attached to the box top interior-facing surface, which is to say facing into the cavity of the box. The box body includes a pair of opposingly oriented mechanical closures and a rubber gasket around a top edge that, when engaged with the box top, form a seal, preventing fluid ingress or egress from the box interior. The box top and body each define a thickness containing a phase change material. In use, the item is subjected to a powder coating process as is known in the art and placed within the oven to cure. The box is placed within the oven in proximity to the item, and at least one thermocouple is connected to the item and the box top. The top is placed on the box and secured in place with the closures, protecting the electronic components positioned in the housing affixed to the box top from the intense heat needed to adequately cure the item. The thermocouple detects the surface temperature of the item and communicates this data to the PCB board, where it is transmitted via the wireless transmitter out of the oven and displayed on a computer device. This method permits the oven user to accurately monitor the temperature and cure quality of the powder coated item without opening the oven and dissipating the thermal energy therein.

DETAILED DESCRIPTION OF THE PREFERRED EMBODIMENT AND OPERATION OF THE INVENTION

Figure 1:
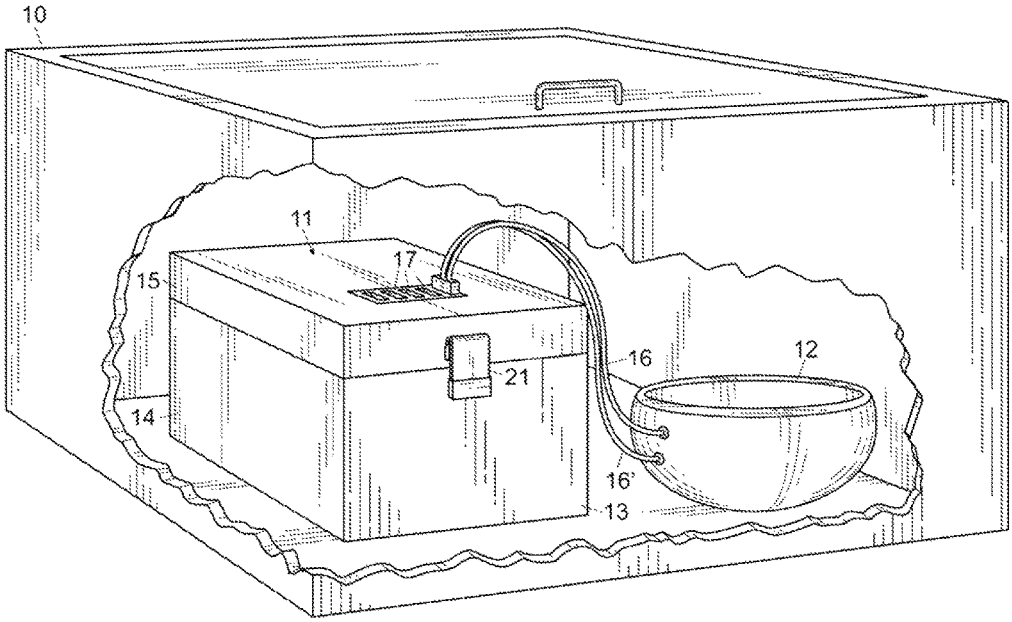
FIG. 1 shows an elevated side perspective view of an oven temperature monitoring system.

For a better understanding of the invention and its operation, turning now to the drawings, FIG. 1 illustrates a schematic representation of curing oven 10 utilizing oven temperature monitoring system 11 and powder coated item 12 positioned inside. It should be understood that curing oven 10 is schematically represented and is intended to include convection cure ovens, infrared cure ovens, laser curing stations, or other platforms capable of heating powder coated item 12 to the appropriate temperature and for the appropriate duration as will be described in further detail below. Similarly, powder coated item 12 is represented schematically as a powder coated bowl but it should be understood that the intended scope of powder coated item 12 includes any item that can withstand the powder coating and curing processes. In alternative embodiments, powder coated item 12 may also include other substrates in need of curing, drying, or the like such as painted items, food items, and so on. Therefore, while the present invention is intended to be used in connection with a powder coating process, it should not be limited to such.

Figure 2:
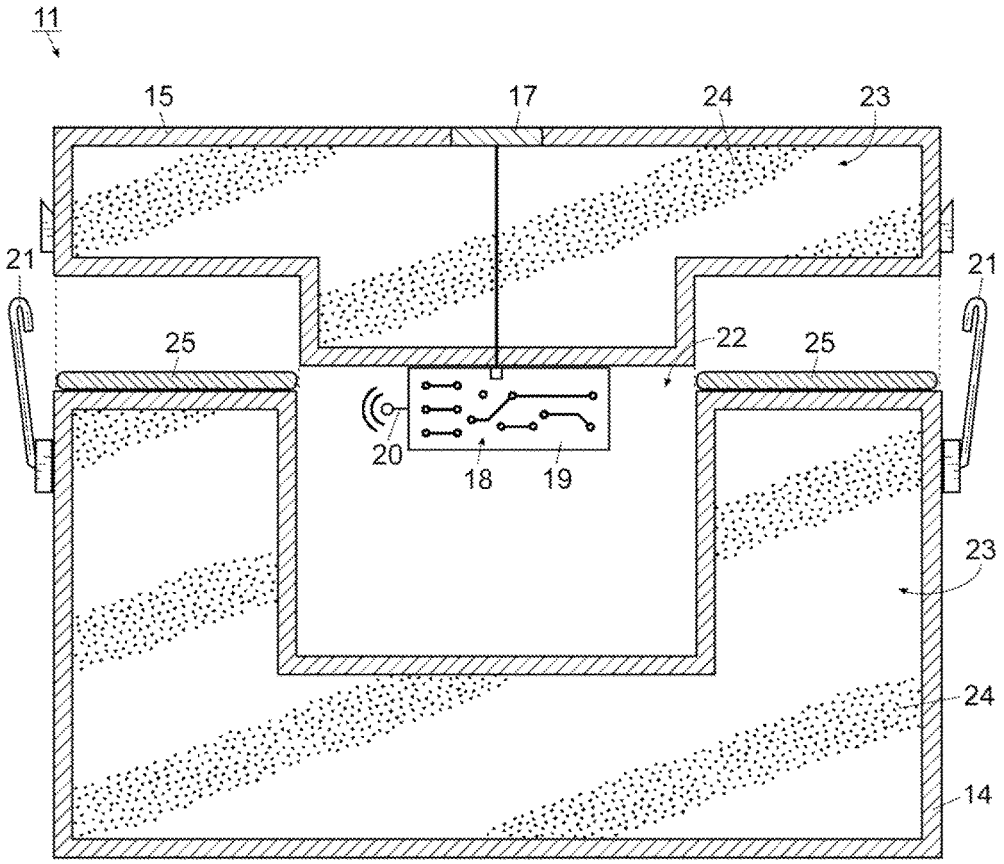
FIG. 2 pictures a cross-sectional elevated side view of the box of FIG. 1.

Preferred oven monitoring system 10 includes box 13 formed from box body 14 and box top 15. An embodiment of box 13 defines a generally rectangular shape and is formed from a material that can withstand the high temperatures common within the normal operating environment of box 13, namely within a curing oven during operation. It should be understood that the shape of this embodiment of box 13 should not be construed as a limitation, and that a variety of regular and irregular polygonal shapes and spheres are contemplated within the scope of box 13. Box 13 is shown in FIGS. 1-2 as being integrally formed from polytetrafluoroethylene, but one or more embodiments of box 13 (not shown) may be substantially formed from polytetrafluoroethylene while also incorporating other structural or desirable materials. As a schematic representations, box body 14 and box top 15 appear to define a singular construction. However, an embodiment of box body 14 may be formed from a plurality of layered side panels (in the case of a square box, four such panels would be appropriate). Such layered panels may define a generally rectangular shape and be formed from at least two planar members, a larger planar member and a smaller planar member (not shown). These planar members are mounted to one another, such that the larger planar member extends beyond the outer perimeter of the smaller planar member, creating a peripheral lip. Box body 14 upper and lower horizontal members may define a groove in which to receive the respective lips, or fasteners and receivers (not shown) such as threaded members and nuts may be used to attach the panels to form box body 14. Additionally, an embodiment of box top 15 is preferably formed from a plurality of layered shims (in the case of a square box, four such shims would be appropriate). Such layered shims may define a generally rectangular shape longer and narrower than the aforementioned panels and be formed from at least two planar sheet members, a larger sheet member and a smaller sheet member (not shown). These sheet members are mounted to one another, such that the larger sheet member extends beyond the outer perimeter of the smaller sheet member, creating a peripheral lip. Box top 15 upper and lower horizontal members may define a groove in which to receive the respective lips, or fasteners and receivers (not shown) such as threaded members and nuts may be used to attach the shims to form box top 15.

It is also desirable for box 13 to possess certain additional functional characteristics, such as the ability to provide a visual indicator to a user as to the temperature within curing oven 10 without opening said oven, as well as permitting the transmission of electronic or radio signals originating from the interior of box 13. The prior art teaches oven profiling systems utilizing steel boxes formed, for example, from stainless steel which do not possess these desired characteristics. Therefore, the structurally defining components of preferred box 13 are formed substantially (meaning all or mostly all) from an alkene fluorocarbon material such as tetrafluoroethylene or more preferably, the fluoropolymer version known as polytetrafluoroethylene (PTFE), various formulas of which (see PFA or FEP by way of example) are sold commercially under the trade name Teflon™. PTFE imbues box 13 with sufficient thermal resistance to withstand temperatures common within curing oven 10 while also permitting the transmission of radio signals from within box 13 as described below. An embodiment of box body 14 includes gasket 25 positioned around the top edge of box body 14 as shown in FIG. 2 and formed from a pliable, preferably polymeric substance such as rubber capable of withstanding oven temperatures. When box top 15 engages box body 14, gasket 25 is compressed and forms a sealed engagement defining the interior from the exterior of box 13.

Box top 15 may define a T-shaped cross section as shown in FIG. 2 and is preferably formed by a smooth, planar exterior surface and defines the same overall length and width as box body 14. The inner surface of box top 15 may include an inward extending projection which serves as the attachment point for housing 18. The exterior surface of box top 15 is the attachment point for one or more pairs of thermocouples 16, 16' utilizing one or more thermocouple receptacles 17 (represented schematically in FIG. 1). FIG. 1 demonstrates a pair of thermocouples 16, 16' attached to powder coated item 12 and box 13, but it should be understood that oven temperature monitoring system 11 can service more than one powder coated item during a curing cycle if configured with additional pairs of thermocouples 16, 16' and an appropriate thermocouple receptacle 17. As would be understood, thermocouples 16, 16' are formed from two dissimilar conductors that contact each other at one or more spots, for example on the surface of powder coated item 12 and box top 15, where a temperature differential is experienced by the different conductors. The junction of dissimilar metals will produce an electric potential related to temperature, and this potential can be recorded in the form of electronic data. On the inward facing surface of box top 15 (the surface more proximate box body 14), box top 15 includes housing 18 sized, shaped, and configured to receive one or more electronic control devices 19. Control device 19 may be any electronic device capable of receiving, storing, and transmitting electronic signals, but preferred electronic control device 19 is a printed circuit board (PCB) and associated power supply in electronic communication with both thermocouple receptacle 17 and antennae 20 configured to transmit the readings of thermocouples 16, 16' outside curing oven 10, for example to a computer monitored by a user (not shown). As referred to herein, the term "computer" should be broadly construed. It can include any type of device capable of electronically presenting data to a user. For example, a computer may be configured to present thermal data to a user. Examples of such computers include, but are not limited to, conventional desktop computers as well as laptop computers. In another example, a computer may be a mobile device such as, for example, but not limited to, a smart phone, a cell phone, a pager, a personal digital assistant (PDA), a mobile computer with a smart phone client, or the like. A computer may also be a typical mobile device with a wireless data access-enabled device (e.g., an iPHONE® smart phone, a BLACKBERRY® smart phone, a NEXUS ONE™ smart phone, an iPAD® device, or the like) that is capable of sending and receiving data in a wireless manner using protocols like the Internet Protocol, or IP, and the wireless application protocol, WAP, or BLUETOOTH®. This allows users to access information via wireless devices, such as smart phones, mobile phones, pagers, two-way radios, communicators, and the like. Wireless data access is supported by many wireless networks, including, but not limited to, CDPD, CDMA, GSM, PDC, PHS, TDMA, FLEX, ReFLEX, iDEN, TETRA, DECT, DataTAC, Mobitex, EDGE and other 2G, 3G, 4G and LTE technologies, and it operates with many handheld device operating systems, such as PalmOS, EPOC, Windows CE, FLEXOS, OS/9, JavaOS, iOS and Android. Typically, these devices use graphical displays and can access the Internet (or other communications network) on so-called mini- or micro-browsers, which are web browsers with small file sizes that can accommodate the reduced memory constraints of mobile wireless devices. In a representative embodiment, the mobile device is a cellular telephone or smart phone that operates over GPRS (General Packet Radio Services), which is a data technology for GSM networks. In addition to a conventional voice communication, a given mobile device can communicate with another such device via many different types of message transfer techniques, including SMS (short message service), enhanced SMS (EMS), multi-media message (MMS), email WAP, paging, or other known or later-developed wireless data formats. As would be understood various other frequencies could be used such as 2.4 Ghz and alternative frequencies may include 868 Mhz, 802.15.4, 802.11 b/g/n, for example in Europe.

Control device 19 and antennae 20 are positioned within housing 18, shown best in the cross-sectional view of FIG. 2. Box top 15 is positioned on top of box body 14 and held firmly in place with one or more mechanical fasteners 21, represented in FIG. 1 as a pair of metallic clasps. While the shape of box 13 may be variable, preferred box body 14 defines a large central void 22 to receive the downwardly projecting housing 18. An embodiment of box body 14 may include voids 23 formed in the thickness of box body 14 and box top 15 for containing a predetermined amount of phase change material 24. Voids 23 are the containers for maintaining phase change material 24 when sufficient thermal energy is absorbed to drive a change in the material from a solid phase to a liquid phase. This phase change is intended to reduce the amount of thermal energy within box 13, thereby reducing the likelihood of thermal damage of control device 19 and antennae 20 during the heating cycle of curing oven 10. Phase change material 24 is intended to be any substance or material that may be classified as a latent heat storage unit, be it organic, inorganic, eutectic, hygroscopic, or other phase change materials as are known in the art.

A method of monitoring the temperature of curing oven 10 to ensure the proper temperature and duration are present to adequately cure powder coated item 12 is also provided. The method includes the step of powder coating item 12 with either a thermoplastic or thermoset polymer powder by methods known in the art, for example by spraying with an electrostatic or corona gun, a triboelectric gun, applying with electrostatic discs, brushing with an electrostatic magnetic brush, dipping into a fluidized or electrostatic fluidized bed, or other methods of powder coating application. The item is then placed in curing oven 10 and thermocouples 16, 16' are attached to a surface of the item and secured in place, for example with a heat-resistant adhesive or preferably a high-temperature solder. Thermocouples 16, 16' are engaged with thermocouple receptacle 17 and phase change material 24 is in the substantially solid state. Curing oven 10 is engaged and a curing cycle is commenced, for example heating powder coated item 12 to about two hundred degrees Celsius (200° C. or 392° F.) for about ten (10) minutes, causing the powder particles to melt and flow over item 12, producing a thick, even coating which hardens into a hard exterior surface when the curing cycle is complete. During the curing cycle, thermocouples 16, 16' are monitoring the temperature of item 12 and transmitting this information to electronic device 19 positioned within housing 18 on the underside of box top 15. In one embodiment of oven temperature monitoring system 11, this information may be stored for later access, for example on a data storage device or a removable data storage device (not shown). Alternatively, or in addition to the previous embodiment, electronic device 19 is communicatively attached to antennae 20 which is configured to transmit the temperature data collected by thermocouples 16, 16' through box top 15 that is made of polytetrafluoroethylene, out of curing oven 10, and received by a computing device operated by a user (not shown). In this manner, the user can monitor the internal temperature of curing oven 10 and the surface temperature of powder coated item 12, ensuring that the correct temperature and required duration variable are present to cure the powder coating onto item 12, without having to open curing oven 10 and dissipating the accumulated thermal energy therein.

The illustrations and examples provided herein are for explanatory purposes and are not intended to limit the scope of the appended claims.

I claim:

1. A method of monitoring the temperature of a curing oven to ensure the proper temperature and duration are present to adequately cure a coated item, the method comprising:

providing a curing oven containing a box with a body and a top, each substantially formed from polytetrafluoroethylene, the top carrying a printed circuit board in communication with an antennae, the printed circuit board communicatively attached to at least one receptacle sized and shaped to receive at least one thermocouple therein, the antennae configured to transmit signals communicated from the at least one thermocouple outside of the box when the top is engaged with the body, positioning the printed circuit board and the antennae completely within the box, inserting a coated item to be cured within the oven, engaging the at least one thermocouple with the item to be cured at a first end of the at least one thermocouple and engaging the receptacle at a second end of the at least one thermocouple, compelling the curing oven to heat the item to be cured to about two hundred degrees Celsius (200° C. or about 392° F.) for a predetermined period of time, receiving thermal information about the item to be cured at the printed circuit board, and transmitting the thermal information via the antennae to a computing device located outside of the curing oven without opening the curing oven.

2. The method of claim 1 wherein the at least one thermocouple is defined by a pair of thermocouples, and wherein the at least one receptacle is defined by a pair of receptacles, the pair of thermocouples in communication with the printed circuit board via the pair of receptacles.

3. The method of claim 1 further comprising a gasket positioned on a top surface of the box body.

4. The method of claim 1 further comprising a pair of mechanical fasteners opposingly positioned on the box body for facilitating the secure engagement of the box top therewith.

5. The method of claim 1 wherein the box body defines a void in a box body thickness, a portion of phase change material positioned within the void.

6. The method of claim 1 wherein the coated item is a powder coated item.

7. The method of claim 1, wherein the predetermined amount of time is about 10 minutes.

8. A method of monitoring the temperature of a curing oven to ensure the proper temperature and duration are present to adequately cure a coated item, the method comprising:

providing a curing oven containing a box with a body and a top, each substantially formed from polytetrafluoroethylene, the top carrying an electronic device in communication with an antennae, the electronic device communicatively attached to at least one receptacle sized and shaped to receive at least one thermocouple therein, the antennae configured to transmit signals communicated from the at least one thermocouple outside of the box when the top is engaged with the body, positioning the electronic device and the antennae completely within the box, inserting a coated item to be cured within the oven, engaging the at least one thermocouple with the item to be cured at a first end of the at least one thermocouple and engaging the receptacle at a second end of the at least one thermocouple, compelling the curing oven to heat the item to be cured for a predetermined period of time, receiving thermal information about the item to be cured at the electronic device, and transmitting the thermal information via the antennae to a computing device located outside of the curing oven.

* * * * *